US008213625B2

(12) United States Patent
Yamkovoy et al.

(10) Patent No.: US 8,213,625 B2
(45) Date of Patent: Jul. 3, 2012

(54) INTERCOM HEADSET CONNECTION AND DISCONNECTION DETECTION

(75) Inventors: Paul G. Yamkovoy, Acton, MA (US); David D. Pape, Framingham, MA (US)

(73) Assignee: Bose Corporation, Framingham, MA (US)

( * ) Notice: Subject to any disclaimer, the term of this patent is extended or adjusted under 35 U.S.C. 154(b) by 545 days.

(21) Appl. No.: 12/431,962

(22) Filed: Apr. 29, 2009

(65) Prior Publication Data

US 2010/0278349 A1 Nov. 4, 2010

(51) Int. Cl.
*H04R 29/00* (2006.01)

(52) U.S. Cl. ..... 381/58; 381/60

(58) Field of Classification Search ..... 381/58–60, 381/71.6

See application file for complete search history.

(56) References Cited

U.S. PATENT DOCUMENTS

| | | | |
|---|---|---|---|
| 4,538,074 | A | 8/1985 | Fraden |
| 6,388,343 | B1 | 5/2002 | Michigami et al. |
| 7,395,090 | B2 | 7/2008 | Alden |
| 8,014,824 | B2 | 9/2011 | Alden |
| 2005/0053243 | A1 | 3/2005 | Ganton |
| 2007/0098190 | A1 | 5/2007 | Song et al. |
| 2007/0225035 | A1 | 9/2007 | Gauger et al. |
| 2007/0235754 | A1 | 10/2007 | Yamamoto |
| 2008/0167092 | A1 | 7/2008 | Ueda et al. |
| 2008/0175402 | A1 | 7/2008 | Abe et al. |
| 2009/0017868 | A1 | 1/2009 | Ueda et al. |
| 2009/0112338 | A1 | 4/2009 | Ueda |
| 2009/0237065 | A1 | 9/2009 | Malasek |
| 2010/0260361 | A1 | 10/2010 | Yamkovoy |

FOREIGN PATENT DOCUMENTS

| | | | |
|---|---|---|---|
| WO | 0113492 | A1 | 2/2001 |
| WO | 2007103951 | A2 | 9/2007 |
| WO | 2008028175 | A2 | 3/2008 |

OTHER PUBLICATIONS

Invitation to Pay Additional Fees dated Jul. 22, 2010 for Int. Appln. No. PCT/US2010/032721.

International Search Report and Written Opinion dated Dec. 13, 2010 for Int. Appln. No. PCT/US2010/032721.

International Search Report and Written Opinion dated Sep. 14, 2011 for International Application No. PCT/US2011/043974.

Invitation to Pay Additional Fees dated Oct. 20, 2011 for Int. Appln. No. PCT/US2011/044356.

International Search Report and Written Opinion dated Nov. 29, 2011 for International Application No. PCT/US2011/044356.

International Preliminary Report on Patentability dated Nov. 10, 2011 for PCT/US2010/032721.

*Primary Examiner* — Benjamin Sandvik
*Assistant Examiner* — Whitney T Moore
(74) *Attorney, Agent, or Firm* — Bose Corporation

(57) ABSTRACT

A headset is able to be coupled via a cable to an intercom system, is able to be wirelessly coupled to a wireless device via a wireless transceiver of the headset, and is able to be connected to a wired device via another cable. A controller of the headset separately monitors the microphone conductors and audio conductors by which the headset may be coupled to the intercom system to detect whether or not one or both of a communications microphone and an acoustic driver of the headset are coupled to the intercom system, and monitors the operating state of the wireless transceiver to detect whether or not the wireless transceiver is inactive, on standby or in use; and selectively couples a system ground conductor to one of the microphone conductors, selectively provides a local sidetone, and/or selectively provides a local microphone bias voltage in response to what is observed through such monitoring.

16 Claims, 3 Drawing Sheets

INTERCOM HEADSET CONNECTION AND DISCONNECTION DETECTION

TECHNICAL FIELD

This disclosure relates to monitoring a connection between a headset and an intercom system, and to possible responses of the headset to being coupled or uncoupled with the intercom system.

BACKGROUND

Two-way communications headsets are in common use in many types of vehicles and with various large pieces of machinery, especially vehicles and machinery that create a high noise environment during operation such that necessary two-way communications with the driver, operator or pilot would be impaired without such headsets. Examples of such noisy environments include airplane cockpits, driver's compartments in commercial trucks and tractors, operator cabins in cranes and tunnel boring machines, and crew compartments in tanks and other military vehicles. It is commonplace for such vehicles and machinery to incorporate an intercom system providing one or more connection points to which such headsets are coupled. Such intercoms typically cooperate with multiple ones of such headsets to enable personnel within or in the immediate vicinity of such vehicles to communicate with each other, and such intercoms typically incorporate long-range wireless transceivers enabling personnel to use such headsets in communicating with other personnel at a distance.

It has recently become increasingly desired to further enable such headsets to be coupled to portable audio devices that personnel may carry with them, in addition to being able to be coupled to an intercom system of a vehicle or large piece of machinery. Therefore, it has become desirable to enable the simultaneous coupling of a headset to both an intercom system and a personal audio device in a manner that provides a high degree of ease of use of such a combination, and avoids electrical incompatibility problems due to changes in a headset's operating state between being coupled to and uncoupled from an intercom system.

SUMMARY

A headset is able to be coupled via a cable to an intercom system, is able to be wirelessly coupled to a wireless device via a wireless transceiver of the headset, and is able to be connected to a wired device via another cable. A controller of the headset separately monitors the microphone conductors and audio conductors by which the headset may be coupled to the intercom system to detect whether or not one or both of a communications microphone and an acoustic driver of the headset are coupled to the intercom system, and monitors the operating state of the wireless transceiver to detect whether or not the wireless transceiver is inactive, on standby or in use; and selectively couples a system ground conductor to one of the microphone conductors, selectively provides a local sidetone, and/or selectively provides a local microphone bias voltage in response to what is observed through such monitoring.

In one aspect, a method of detecting coupling of a headset to an intercom system includes: injecting a current into at least one audio conductor used to convey a signal representing audio to an acoustic driver of the headset; monitoring the voltage of the at least one audio conductor relative to a ground conductor associated with the at least one audio conductor; determining that the at least one audio conductor is coupled to the intercom system in response to the monitored voltage being within a first range of voltages; and determining that the at least one audio conductor is not coupled to the intercom system in response to the monitored voltage being within a second range of voltages, wherein the second range of voltages is higher than the first range of voltages.

Implementations may include, and are not limited to, one or more of the following features. The method may further include determining that the at least one audio conductor is coupled to the intercom system and determining that the intercom system is not driving the at least one audio conductor in response to the monitored voltage being within a third range of voltages, wherein the third range of voltages is higher than the first range of voltages and is lower than the second range of voltages. The method may further include refraining from providing a microphone bias voltage across a pair of microphone conductors used to convey signals representing audio detected by a communications microphone of the headset in response to determining that the at least one audio conductor is coupled to the intercom system and in response to determining that the intercom system is not driving the at least one audio conductor. The method may further include performing a test of at least one microphone conductor of a pair of microphone conductors used to convey signals representing audio detected by a communications microphone of the headset to determine whether the at least one microphone is coupled to the intercom system; and monitoring the operating state of a wireless transceiver of the headset to determine if the wireless transceiver is inactive, on standby in preparation to be used in two-way communications, or in use.

Performing the test of the at least one microphone conductor may include monitoring the pair of microphone conductors for a bias voltage being provided across the pair of microphone conductors; determining that the at least one microphone conductor is coupled to the intercom system in response to detecting a bias voltage across the pair of microphone conductors; and determining that the at least one microphone conductor is not coupled to the intercom system in response to not detecting a bias voltage across the pair of microphone conductors. Alternatively and/or additionally, performing the test of the at least one microphone conductor may include injecting a current into the at least one microphone conductor; monitoring the voltage across the pair of microphone conductors; determining that the at least one microphone conductor is coupled to the intercom system in response to the monitored voltage being within a first range of voltages; and determining that the at least one microphone conductor is not coupled to the intercom system in response to the monitored voltage being within a second range of voltages, wherein the second range of voltages is higher than the first range of voltages. The method still further include coupling the ground conductor associated with the at least one audio conductor to a microphone conductor of the pair of microphone conductors, and providing a sidetone from the communications microphone to the acoustic driver in response to either of the at least one audio conductor or the at least one microphone conductor not being coupled to the intercom system, and in response to the wireless transceiver being in use. Alternatively and/or additionally, the method may still further include coupling the ground conductor associated with the at least one audio conductor to a microphone conductor of the pair of microphone conductors in response to either of the at least one audio conductor or the at least one microphone conductor not being coupled to the intercom system, and in response to the wireless transceiver being on standby. The method may still further include providing a microphone bias voltage across the pair of microphone conductors in response to the at least one microphone conductor not being coupled to the intercom system, and in response to the wireless transceiver being in use.

In one aspect, a headset includes an acoustic driver to acoustically output audio to an ear of a user; a communications microphone to detect speech sounds of the user; and a wireless transceiver to wirelessly couple the headset to a wireless device; a cable assembly to couple the headset to an intercom system. The cable assembly includes an audio conductor used to convey a signal representing audio to the acoustic driver; a ground conductor associated with the audio conductor; and a pair of microphone conductors used to convey signals representing audio detected by the communications microphone. The headset further includes an excitation current injector to inject a current into the audio conductor; a voltage sensor to monitor a voltage of the of the audio conductor relative to the ground conductor; and a controller coupled to the excitation current injector and the voltage sensor to determine that the audio conductor is coupled to the intercom system in response to the voltage sensor detecting a voltage within a first range of voltages, and to determine that the audio conductor is not coupled to the intercom system in response to the voltage sensor detecting a voltage within a second range of voltages, wherein the second range of voltages is higher than the first range.

Implementations may include, and are not limited to, one or more of the following features. The headset may further include an audio signal presence detector coupled to the controller to detect activity on the audio conductor; and an audio signal interrupter to divide the audio conductor to isolate a portion of the audio conductor into which the excitation current injector injects a current from another portion of the audio conductor; wherein the controller awaits an indication from the audio signal presence detector of there being no activity on the audio conductor prior to operating the audio signal interrupter to divide the audio conductor, operating the excitation current injector to inject a current into the audio conductor, and awaiting an indication from the voltage sensor of the voltage of the audio conductor. The headset may further include a bias voltage detector coupled to the controller to monitor the pair of microphone conductors for a microphone bias voltage conductors, wherein the controller determines that at least one microphone conductor of the pair of microphone conductors is coupled to the intercom system in response to detecting a bias voltage across the pair of microphone conductors; and wherein the controller determines that the at least one microphone conductor is not coupled to the intercom system in response to not detecting a bias voltage across the pair of microphone conductors. The headset may further include a ground coupler coupled to the controller to couple the ground conductor to one of the microphone conductors of the pair of microphone conductors in response to either the audio conductor or at least one microphone conductor of the pair of microphone conductors not being coupled to the intercom system, and in response to the wireless transceiver being in use; and a local sidetone generator coupled to the controller to generate a sidetone from the communications microphone to the acoustic driver in response to either the audio conductor or the at least one microphone conductor not being coupled to the intercom system, and in response to the wireless transceiver being in use. The controller may operate the ground coupler to couple the ground to a microphone conductor of the pair of microphone conductors in response to either of the at least one audio conductor or the at least one microphone conductor not being coupled to the intercom system, and in response to the wireless transceiver being on standby.

The controller may further determine that the audio conductor is coupled to the intercom system and determines that the intercom system is not driving the at least one audio conductor in response to the voltage sensor detecting a voltage within a third range of voltages, wherein the third range of voltages is higher than the first range of voltages and is lower than the second range of voltages. The headset may still further include a bias voltage supply coupled to the controller to provide a microphone bias voltage across the pair of microphone conductors, and wherein the controller refrains from operating the bias voltage supply to provide a microphone bias voltage across the pair of microphone conductors in response to determining that the at least one audio conductor is coupled to the intercom system and in response to determining that the intercom system is not driving the at least one audio conductor.

Other features and advantages of the invention will be apparent from the description and claims that follow.

DETAILED DESCRIPTION

What is disclosed and what is claimed herein is intended to be applicable to a wide variety of headsets, i.e., devices structured to be worn on or about a user's head in a manner in which at least one acoustic driver is positioned in the vicinity of an ear, and in which a microphone is positioned in the vicinity of the user's mouth to enable two-way audio communications. It should be noted that although specific embodiments of headsets incorporating a pair of acoustic drivers (one for each of a user's ears) are presented with some degree of detail, such presentations of specific embodiments are intended to facilitate understanding through examples, and should not be taken as limiting either the scope of disclosure or the scope of claim coverage.

It is intended that what is disclosed and what is claimed herein is applicable to headsets that also provide active noise reduction (ANR), passive noise reduction (PNR), or a combination of both. It is intended that what is disclosed and what is claimed herein is applicable to headsets structured to be connected with at least an intercom system through a wired connection, but which may be further structured to be connected to any number of additional devices through wired and/or wireless connections. It is intended that what is disclosed and what is claimed herein is applicable to headsets having physical configurations structured to be worn in the vicinity of either one or both ears of a user, including and not limited to, over-the-head headsets with either one or two earpieces, behind-the-neck headsets, two-piece headsets incorporating at least one earpiece and a physically separate microphone worn on or about the neck, as well as hats or helmets incorporating earpieces and a microphone to enable audio communication. Still other embodiments of headsets to which what is disclosed and what is claimed herein is applicable will be apparent to those skilled in the art.

Figure 1:
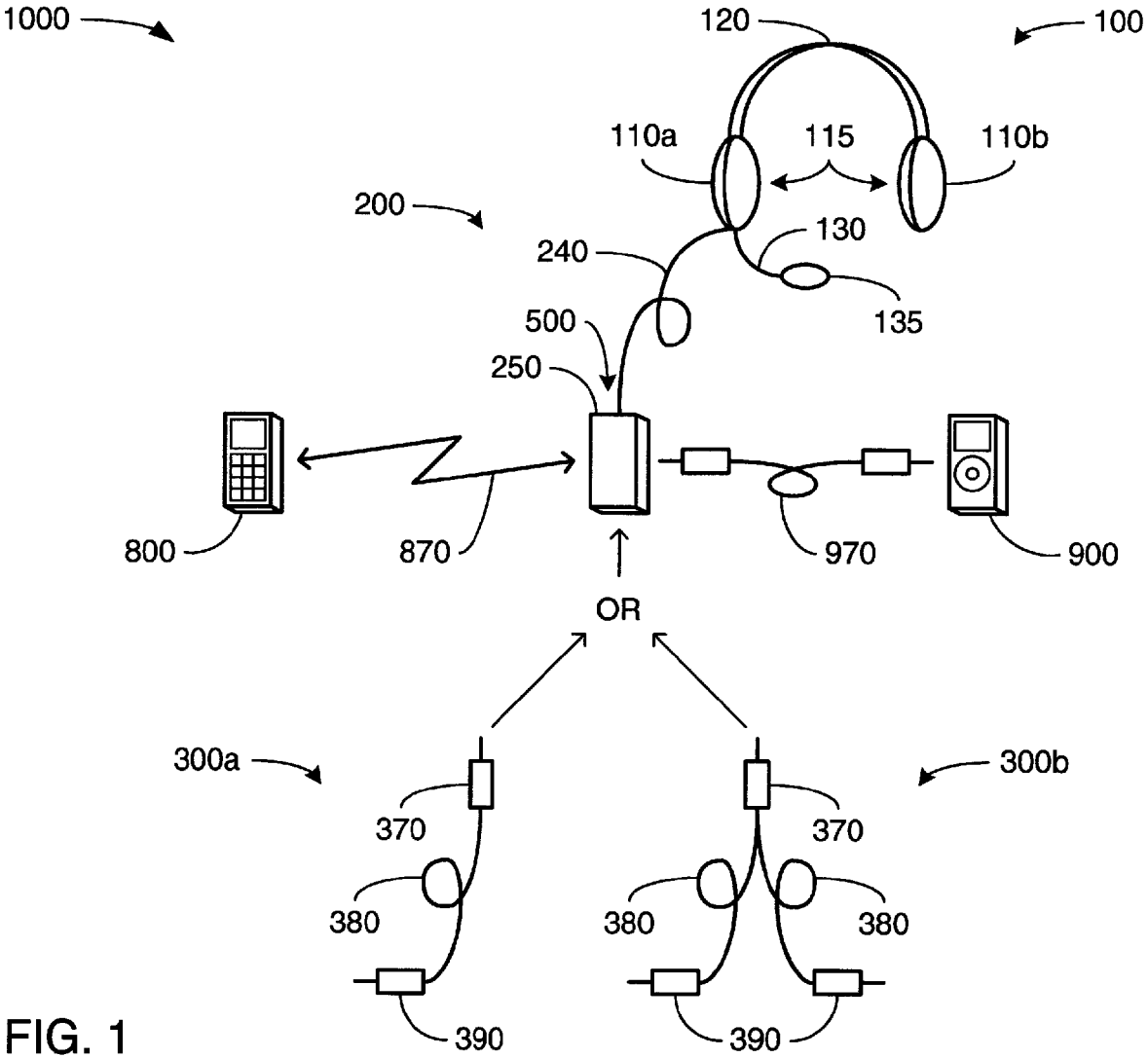
FIG. 1 is a perspective diagram of a headset.

FIG. 1 depicts an embodiment of a headset 1000 having an "over-the-head" physical configuration. The headset 1000 incorporates a head assembly 100, an upper cable assembly

200, and one or the other of a lower cable assembly 300*a* and a lower cable assembly 300*b*. The head assembly 100 incorporates a pair of earpieces 110*a* and 110*b* that each incorporate an acoustic driver 115, a headband 120 that couples together the earpieces 110*a* and 110*b*, and a microphone boom 130 extending from the earpiece 110*a* to support a communications microphone 135. The upper cable assembly 200 incorporates a control box 250 having a control circuit 500, and an electrically conductive cable 240 that couples the control box 250 to the earpiece 110*a*. The lower cable assembly 300*a* incorporates an upper coupling 370 that detachably couples the cable assembly 300*a* to the control box 250, a lower coupling 390 that detachably couples the cable assembly 300*a* to an intercom system (not shown), and an electrically conductive cable 380 that couples together the upper coupling 370 and the lower coupling 390. Similarly, the lower cable assembly 300*b* incorporates an upper coupling 370 that detachably couples the cable assembly 300*b* to the control box 250, a pair of lower couplings 390 that detachably couples the cable assembly 300*b* to an intercom system (not shown), and an electrically conductive split form of cable 380 that couples together the upper coupling 370 and the pair of lower couplings 390.

The head assembly 100 is given its over-the-head physical configuration by the headband 120. Depending on the size of each of the earpieces 110*a* and 110*b* relative to the typical size of the pinna of a human ear, each of the earpieces 110*a* and 110*b* may be either an "on-ear" (also commonly called "supra-aural") or an "around-ear" (also commonly called "circum-aural") form of earcup. As will be explained in greater detail, the provision of an acoustic driver 115 in each of the earpieces 110*a* and 110*b* enables the headset 1000 to acoustically output two-channel audio (e.g., stereo audio) to a user. The microphone boom 130 positions the communications microphone 135 is the vicinity of the mouth of a user of the headset 1000 when the head assembly 100 is correctly worn such that the earpieces 110*a* and 110*b* overly corresponding ones of the user's ears. However, despite the depiction in FIG. 1 of this particular physical configuration of the head assembly 100, those skilled in the art will readily recognize that the head assembly may take any of a variety of other physical configurations. By way of example, alternate embodiments may incorporate only one of the earpieces 110*a* and 110*b* to acoustically output only one-channel audio, may incorporate a "behind-the-head" or "behind-the-neck" variant of band in place of the headband 120, may position the communications microphone 135 on a portion of one or the other of the earpieces 110*a* and 110*b* (rather than at the end of the microphone boom 130), and/or may be structured to permit one or both of the cable 240 and the microphone boom 130 to be detachable from the earpiece 110*a* in order to be attached to the earpiece 110*b*.

The upper cable assembly 200 provides a cable-based coupling of the control box 250 the earpiece 110*a* (or possibly the earpiece 110*b*, as just discussed) through the cable 240. As will be explained in greater detail, the control circuit 500 within the control box 250 enables a user of the headset 1000 to interact with more than just an intercom system through the headset 1000. The control circuit 500 may incorporate a wireless transceiver that enables wireless communications via wireless signals 870 (e.g., infrared signals, radio frequency signals, etc.) between the control circuit 500 and a wireless device 800 (e.g., a cell-phone, an audio recording and/or playback device, a two-way radio, etc.) to thereby enable a user to interact with the wireless device 800 through the headset 1000. The control box 250 may incorporate an auxiliary input enabling the control circuit 500 to be coupled through a cable 970 to a wired device 900 (e.g., an audio playback device, an entertainment radio, etc.) to enable a user to listen through the headset 1000 to audio provided by the wired device 900. Although not specifically depicted in FIG. 1, in various possible embodiments, the control box 250 may provide one or more manually-operable controls to enable the user to control one or more aspects of the operation of the headset 1000, possibly including coordinating the transfer of audio among the headset 1000, an intercom system to which the headset may be coupled via one or the other of the lower cable assemblies 300*a* and 300*b*, the wireless device 800 and the wired device 900. Further, and although also not depicted in FIG. 1, the control circuit 500 may be incorporated into one or both of the earpieces 110*a* and 110*b* (or some other portion of the head assembly 100) in addition to or as an alternative to being incorporated within the control box 250, thereby possibly obviating the need for the upper cable assembly 200 to incorporate the control box 250.

Each of the lower cable assemblies 300*a* and 300*b* enable the coupling of the headset 1000 to an intercom system of a vehicle or large piece of machinery, including and not limited to, a truck, multi-car train, military vehicle, airplane, seafaring vessel, crane, tunnel boring machine, harvester, combine or tractor. As previously discussed, the lower cable assembly 300*a* incorporates a single lower connector 390 for coupling to an intercom system, while the lower cable assembly 300*b* incorporates a pair of lower connectors 390. As will be readily recognized by those having familiarity with such vehicles or large pieces of machinery, despite standards that may exist in some industries, it is not uncommon for manufacturers of different ones of such vehicles or large pieces of machinery to provide intercom systems having characteristics that vary among those manufacturers. Among those varying characteristics is the separation of outgoing and incoming audio signals to be conveyed through two separate connectors by some manufacturers, while other manufacturers choose to combine both outgoing and incoming audio signals to be conveyed through a single connector. Thus, the lower cable assembly 300*a* is structured to enable the headset 1000 to be coupled to intercom systems employing a single connector through the single lower coupling 390, while the lower cable assembly 300*b* is structure to enable the headset 1000 to be coupled to intercom systems employing separate connectors through the separate ones of the pair of lower couplings 390. Although a split form of the cable 380 of the cable assembly 300*b* is depicted as splitting at or in the vicinity of the upper coupling 370, it will be apparent to those skilled in the art that other physical configurations of the cable 380 that accommodate the separation of incoming and outgoing signals among the pair of lower couplings 390 are possible.

Figure 2:
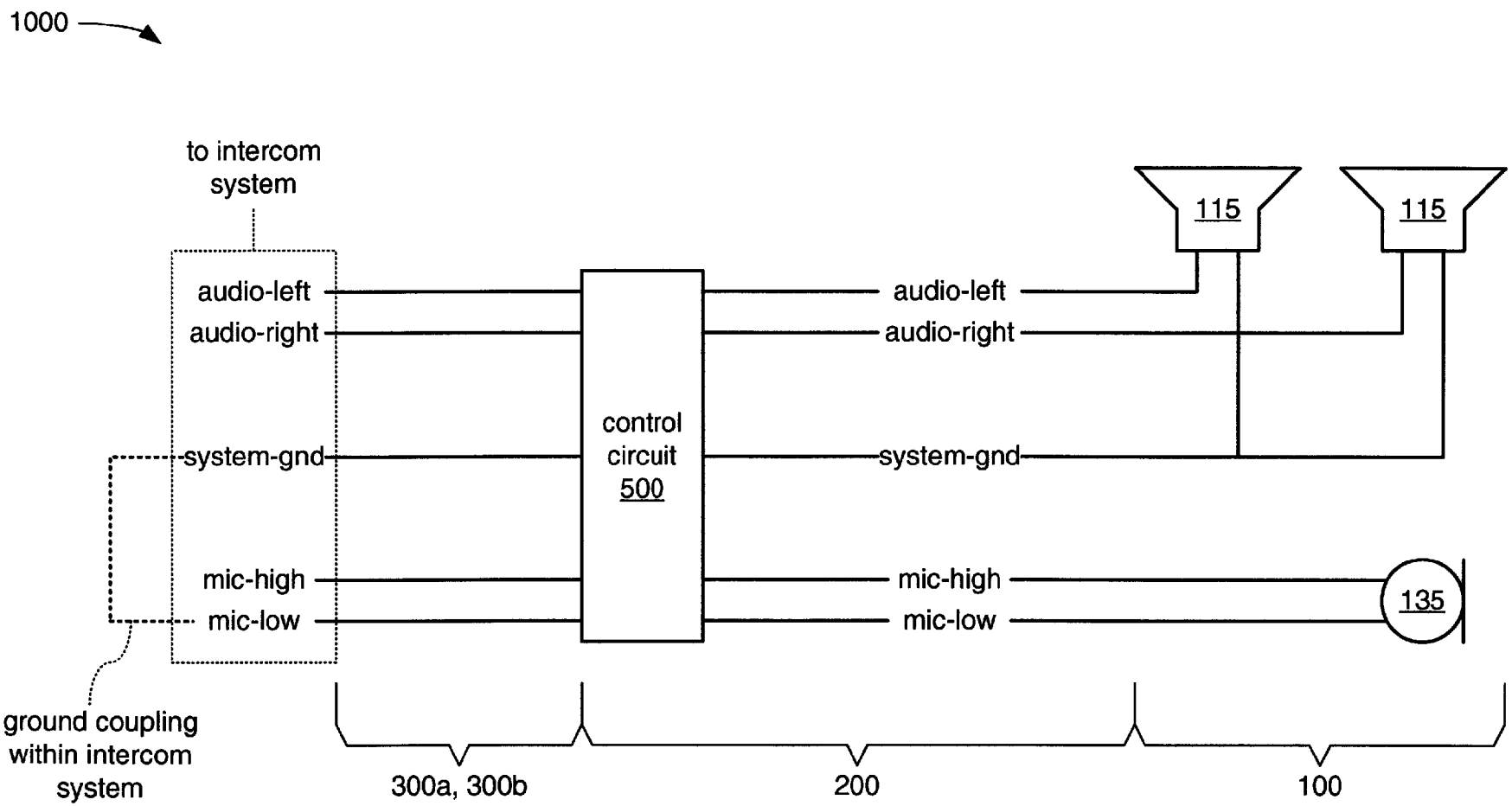
FIG. 2 is a block diagram of an electrical architecture employable in the headset of FIG. 1.

FIG. 2 depicts a possible embodiment of an electrical architecture that may be employed by the headset 1000. With one or the other of the lower cable assemblies 300*a* and 300*b* coupling the control box 250 of upper cable assembly 200 to an intercom system, and with the control box 250 being coupled to the head assembly 100 via the rest of the upper cable assembly 200, left and right audio signals (along with system ground) are able to be conveyed from the intercom system to the acoustic drivers 115, and high and low microphone signals are able to be conveyed from the communications microphone 135 to the intercom system. As will be explained in greater detail, the control circuit 500 incorporated within the control box 250 monitors the coupling of the headset 1000 to an intercom system, and controls the conveying of these signals, controls the local provision of sidetone and local microphone biasing voltage. As will also be explained in greater detail, the control circuit controls the local coupling of the system ground of the acoustic drivers 115 to the microphone low signal of the communications microphone 135, at least partly in response to whether or not the headset 1000 is coupled to an intercom system such that such a coupling is already made within the intercom system. In this way, the headset 1000 is able to be employed in interactions by a user with numerous possible combinations of an intercom system, a wireless device 800 and a wired device 900.

Figure 3:
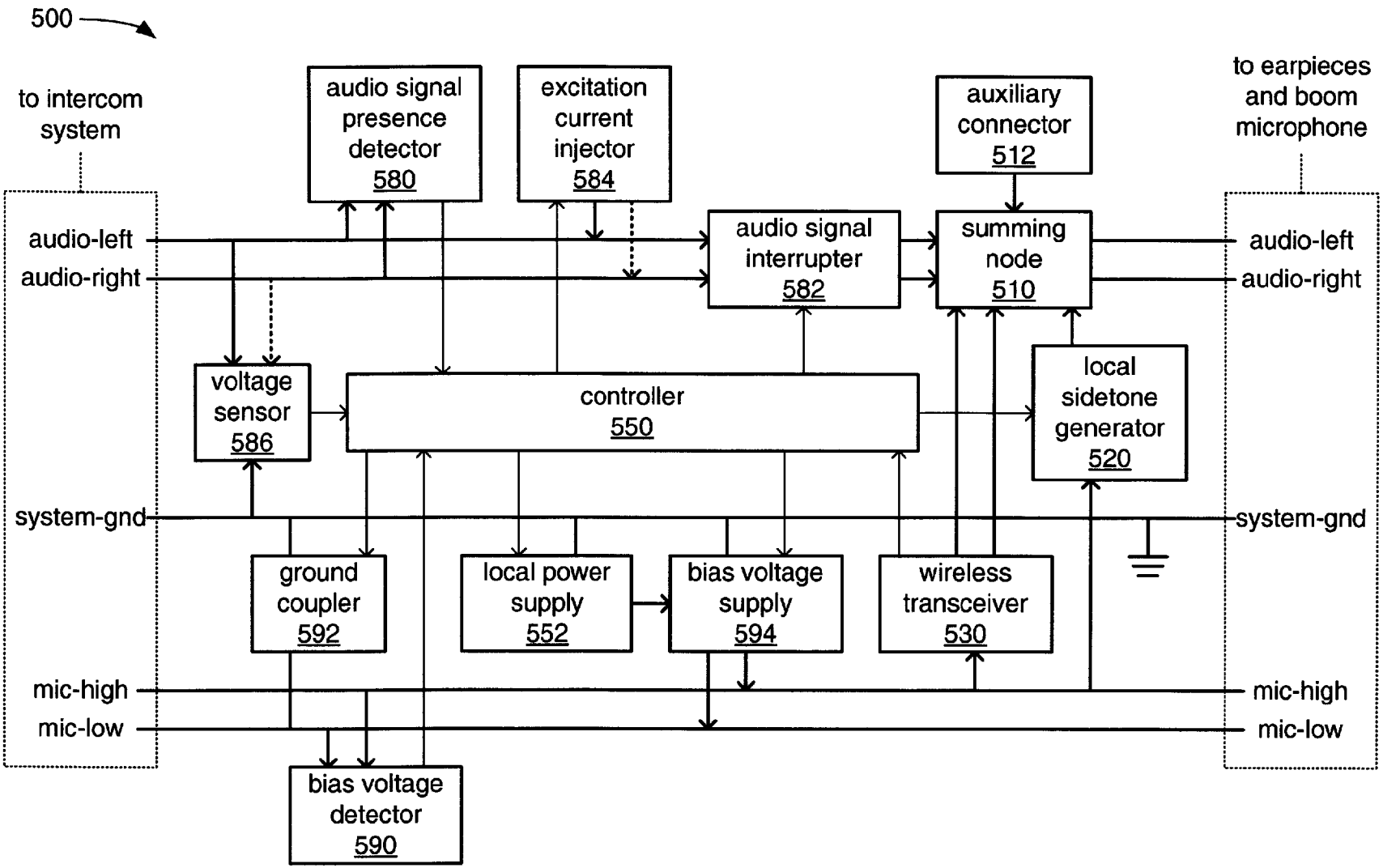
FIG. 3 is a block diagram of a control circuit of the electrical architecture of FIG. 2.

FIG. 3 depicts a possible embodiment of an electrical architecture that may be employed by the control circuit 500. In employing this electrical architecture, the control circuit 500 incorporates a summing node 510, an auxiliary connector 512, a sidetone generator 520, wireless transceiver 530, a controller 550, a local power supply 552, an audio signal presence detector 580, an audio signal interrupter 582, an excitation current injector 584, a voltage sensor 586, a bias voltage detector 590 and a ground coupler 592. The controller 550 is coupled to many others of these components to monitor and/or control their functions as will be explained in greater detail. Also, and although the connections are not specifically depicted for sake of clarity of presentation, the local power supply 552 provides power to others of these components. Further, the power provided by the power supply 552 is preferably referenced to the system-gnd conductor, which is also the reference ground provided by an intercom system (when the headset 1000 is coupled to an intercom system such that the system-gnd conductor is coupled to that intercom system).

The summing node 510 combines the left and right audio signals provided by an intercom system (if the headset 1000 is coupled to an intercom system) with audio provided by a wired device (if the headset 1000 is coupled to a wired device), audio provided by the local sidetone generator 520 (if active), and audio provided by the wireless transceiver 530 (if active). Where a source of audio provides only single-channel audio (otherwise known as "mono"), the summing node 510 may combine that audio with only one of the audio-left and audio-right signals, or both. Though not specifically depicted, in some embodiments, the control box and/or at least one of the earpieces 110*a* and 110*b* may carry one or more manually-operable controls to enable a user of the headset 1000 to select or in some other way control what sources of audio are conveyed through the summing node 510 and ultimately to the acoustic drivers 115. In a preferred embodiment of the headset 1000 for use in at least aircraft, there would be no manually-operable control by which audio provided by an intercom system would be prevented from being conveyed to the acoustic drivers 115. The summing node 510 may be implemented as a resistor network, a summing amplifier, or other mechanism for combining audio as will be familiar to those skilled in the art.

The auxiliary connector 512 enables a wired device (such as the wired device 900 depicted in FIG. 1) to be coupled by a cable (such as the cable 970) to control circuit 500 to thereby allow audio provided by the wired device to be summed with other audio by the summing node 510, and ultimately provided to the acoustic drivers 115. In various possible embodiments, the auxiliary connector 512, in cooperation with the summing node 510, may enable the provision of either single-channel or two-channel audio for being combined with other audio by the summing node 510. As depicted, the auxiliary connector 512 makes no provision for a two-way exchange of audio. However, as those skilled in the art will readily recognize, other variations of the auxiliary connector 512 are possible through which signals from the communications microphone 135 are made available to a wired device coupled to the auxiliary connector 512.

The local sidetone generator 520 can be employed to convey sounds detected by the communications microphone 135 to the acoustic driver 115 (through the summing node 510) as a way of providing a user of the headset 1000 a more natural acoustic experience when talking. Studies have revealed that people are accustomed to hearing the sound of their own voice when talking, that the human mind uses this self-hearing of speech as part of regulating speech volume (i.e., how loud to talk), and that an inability to maintain an appropriate speech volume begins to occur when a person is substantially prevented from hearing themselves talk. Especially in embodiments of the headset 1000 in which the earpieces provide some degree of either passive or active noise reduction, and especially when the headset 1000 is used in a noisy environment, the ability of a person to hear their voice well enough to enable normal self-regulation of speech volume can become greatly impaired. The sidetone generator 520 passes through a variation of the sounds detected by the communications microphone 135 that may be attenuated and/or filtered in some way to approximate the normal experience of a person hearing themselves talk in order to enable normal self-regulation of speech volume. In some embodiments, sounds detected by the communications microphone may be subjected to a bandpass filter within the local sidetone generator 520 to limit sounds conveyed to the summing node 510 to those within a range of frequencies typically associated with human speech.

The wireless transceiver 530 enables a wireless device (such as the wireless device 800 depicted in FIG. 1) to be wirelessly coupled to the control circuit 500 to thereby allow audio received from the wireless device to be summed with other audio by the summing node 510, and to thereby allow sounds detected by the communications microphone 135 to transmitted to the wireless device. In this way, two-way audio communications is enabled between the headset 1000 and such a wireless device. In various embodiments, the wireless coupling may be through radio frequency (RF) signals, possibly RF signals meant to comply with one or more widely known and used industry standards for RF communication including, and not limited to, the Bluetooth specification promulgated by the Bluetooth SIG based in Bellevue, Wash., or the ZigBee specification promulgated by the ZigBee Alliance based in San Ramon, Calif.

The audio signal presence detector 580 monitors the audio-left and audio-right conductors of the lower cable assembly 300*a* or 300*b* for activity associated with signals conveying sounds from an intercom system (if the headset 1000 is coupled to an intercom system) and ultimately to the acoustic drivers 115. The audio signal interrupter 582 is able to be operated to selectively disconnect the audio-left and audio-right conductors of the lower cable assembly 300*a* or 300*b* from the audio-left and audio-right conductors coupled through the upper cable assembly 200 to head assembly 100. The excitation current injector 584 is able to be operated to selectively function as a current source injecting a current onto one or both of the audio-left and audio-right conductors of the lower cable assembly 300*a* or 300*b*. The voltage sensor 586 is able to measure a voltage that might be present on one or both of the audio-left and audio-right conductors of the lower cable assembly 300*a* or 300*b* (as a result of the injection of current by the excitation current injector 584) as referenced to the system-gnd conductor.

The bias voltage detector 590 is able to detect the presence or absence of a microphone bias voltage across the mic-high and mic-low conductors. As previously explained, in typical intercom systems, the mic-low and system-gnd conductors are coupled together. However, as also previously explained, the possible use of the lower cable assembly 300*b* makes possible a situation where only one or the other of the system-gnd and mic-low conductors is coupled to an intercom system, thereby preventing the coupling of the mic-low conductor to the system-gnd conductor such that the mic-low conductor may be floating relative to the system ground conductor. Therefore, in order to detect a bias voltage across the mic-low and mic-high conductors at a time when the mic-low conductor is floating relative to the system-gnd conductor, an the bias voltage detector 590 may be implemented with an opto-isolator. The ground coupler 592 is able to be operated to selectively couple the system-gnd conductor to the mic-low conductor. In an effort to minimize power consumption by the ground coupler 592, it may be implemented using a MOSFET. The bias voltage supply 594 is able to be operated to selectively provide a microphone bias voltage on the mic-high and mic-low conductors.

The controller 550 is coupled to and receives signals indicating status from one or more of the wireless transceiver 530, the audio signal presence detector 580, the voltage sensor 586, and the bias voltage detector 590. The controller is coupled to and sends signals to operate one or more of the local sidetone generator 520, the audio signal interrupter 582, the excitation current generator 584 and the ground coupler 592. The controller 550 may be implemented in any of a number of ways. In some embodiments, the controller 550 is a combination of a processing device and a storage device in which is stored a sequence of instructions that is executed by the processing device of the controller 550 to cause that processing device to perform a number of tasks as are described herein. Possible implementations of such a processing device include, and are not limited to, a general purpose central processing unit (CPU), a digital signal processor (DSP), a microcontroller, a sequencer, and a state machine implemented with discrete logic. Possible implementations of such a storage include, and are not limited to, dynamic random access memory (DRAM), static random access memory (SRAM), read-only memory (ROM), electrically erasable programmable read-only memory (EEPROM), any of a variety of other types of volatile and/or non-volatile solid state memory storage technologies, magnetic and/or optical storage media, and any of a variety of other types of storage media.

The controller 550 cooperates with the audio signal presence detector 580, the audio signal interrupter 582, the excitation current injector 584 and the voltage sensor 586 to perform a test to determine whether or not at least the audio-left, the audio-right and the system-gnd conductors of the lower cable assembly 300*a* or 300*b* are connected to an intercom system on a recurring basis. The audio signal presence detector 580 signals the controller 550 upon detecting an instance of their being a lack of activity on one or both of the audio-left and audio-right conductors of the lower cable assembly 300*a* or 300*b* consistent with no audio being provided by an intercom system. In response, the controller 550 may operate the audio signal interrupter 582 to disconnect the audio-left and audio-right conductors of the lower cable assembly 300*a* or 300*b* from the same two conductors that are coupled to the head assembly 100. Then, while the audio signal interrupter is still operated to disconnect conductors, the controller 550 may operate the excitation current injector 584 to function as a current source and output a current onto one or both of the audio-left and audio-right conductors coupled to the lower cable assembly 300*a* or 300*b*, while the voltage sensor 586 signals the controller 550 with an indication of what voltages are observed on one or both of these conductors. As will be familiar to those skilled in the art, if the audio-left, audio-right and system-gnd conductors of the lower cable assembly 300*a* or 300*b* are not coupled to an intercom system, there will be a very high resistance (theoretically, a near-infinite resistance) between the system-gnd conductor and each of the audio-left and audio-right conductors such that a relatively high voltage will be found to be present by the voltage sensor 586 on one or both of the audio-left and audio-right conductors relative to the system-gnd conductor. However, if these conductors are coupled to an intercom system, then there will be a far lower resistance between the system-gnd conductor and each of the audio-left and audio-right conductors such that a relatively low voltage will be found to be present by the voltage sensor 586.

If the voltage sensor 586 indicates to the controller 550 that voltages consistent with these conductors being coupled to an intercom system are present, then the controller 550 operates the audio signal interrupter 582 to reconnect conductors and operates the excitation current injector 584 to cease sourcing a current onto either of the audio-left and audio-right conductors of the lower cable assembly 300*a* or 300*b*. However, if the voltage sensor 586 indicates to the controller that voltages consistent with no such connection to an intercom system are present, then the controller 550 may continue to operate the audio signal interrupter 582 to continue disconnecting conductors, and may continue to operate the excitation current injector 584 to source a current onto one or both of the audio-left and audio-right conductors, either continuously or on a repeating interval. Such use of the audio signal interrupter 582 to disconnect conductors serves to ensure that the voltages seen are not influenced by resistances and/or currents from other components of the headset 1000, and serves to ensure that the user is not caused to hear various audio artifacts (e.g., popping, static, crackling or buzzing noises).

The controller 500 additionally cooperates with the transceiver 530, the bias voltage detector 590, the ground coupler 592 and the bias voltage supply 594 to determine whether or not the mic-high and mic-low conductors are connected to an intercom system, and to determine whether to couple the system-gnd and mic-low conductors, provide a bias voltage across the mic-low and mic-high conductors, and/or provide sidetone. These actions that the controller 500 may take are in recognition of the fact that in the electrical architecture for the control circuit 500 depicted in FIG. 3, the communications microphone provides signals representing sounds that it has detected only to one or both of an intercom system (if the headset 1000 is coupled to an intercom system) and the transceiver 530. These actions are also taken in recognition of the fact that the mic-low and system-gnd conductors are typically coupled within an intercom system to which the headset 1000 may be coupled, and that it is usually desirable to avoid also coupling those same conductors within a headset used with such an intercom system due to the possible introduction of electromagnetic interference and audible noise that may arise from the ground loop that may be created by such a redundant connection within a headset. It should be noted that these possible actions may differ somewhat from what is about to be described for the depicted electrical architecture in a case where the control circuit 500 employs an alternate electrical architecture that additionally accommodates two-way communication through the auxiliary connector 512.

At times when the wireless transceiver 530 has been turned off or otherwise put into an inactive operating state by the user in which the transceiver 530 is neither prepared for use nor in use, the controller 550 ignores all indications from the bias voltage detector 590 of whether or not there is a bias voltage present across the mic-high and mic-low conductors, and ignores all results of tests performed to determine whether or not at least the audio-left, audio-right and system-gnd conductors are coupled to an intercom system. At these times, the controller 550 operates the ground coupler 592 to not couple the system-gnd and mic-low conductors, operates the bias voltage supply 594 to not provide a bias voltage across the mic-low and mic-high conductors, and operates the local sidetone generator 520 to not provide sidetone. In this way, electric power is not wasted by the bias voltage supply 594 providing a bias voltage or the local sidetone generator 520 providing a sidetone when neither is needed as a result of the communications microphone 135 not being used with the wireless transceiver 530. At these times, it is still possible for the communications microphone 135 to be used with an intercom system, since it is typical for intercom systems of vehicles and large machinery to provide sidetone and any needed bias voltage.

At times when the wireless transceiver 530 enters into or remains in the standby operating state such that it is prepared for being used, the controller 550 makes use of indications provided by the bias voltage detector 590 and results of the tests of whether the audio-left, audio-right and system-gnd conductors are coupled to an intercom system. The controller 550 uses such indications and test results in determining whether or not to operate the ground coupler 592 to couple the system-gnd and mic-low conductors in preparation for the communications microphone 135 being used with the wireless transceiver 530. However, as long as the transceiver 530 indicates to the controller 550 that the transceiver 530 is on standby, the controller 550 operates the bias voltage supply 594 to refrain from providing a bias voltage, and operates the local sidetone generator 520 to refrain from providing sidetone. While the transceiver 530 is on standby, if the bias voltage detector 590 does not detect a bias voltage, then it's presumed that the mic-low and mic-high conductors are not coupled to an intercom system, and the controller 550 operates the ground coupler 592 to couple the mic-low conductor to the system-gnd to prepare the communications microphone 135 for use with the transceiver 530.

Alternatively, while the transceiver 530 is on standby, if the bias voltage detector 590 does detect a bias voltage, then it's presumed that the mic-low and mic-high conductors are coupled to an intercom system. If results of tests to determine whether or not the audio-left, audio-right and system-gnd conductors are also coupled to the intercom system indicate that those conductors are so coupled, then the controller 550 operates the ground coupler 592 to not couple the mic-low and system-gnd conductors to avoid creating a ground loop. However, if results of tests to determine whether or not the audio-left, audio-right and system-gnd conductors are also coupled to the intercom system indicate that those conductors are not so coupled, then the controller 550 operates the ground coupler 592 to couple the mic-low and system-gnd conductors, since they are not able to be coupled through the intercom system.

At times when the wireless transceiver 530 transitions into the operating state of being in use or remains in use, the controller 550 makes use of indications provided by the bias voltage detector 590 and results of the tests of whether the audio-left, audio-right and system-gnd conductors are coupled to an intercom. The controller 550 uses such indications and test results in determining whether or not to operate the ground coupler 592 to couple the system-gnd and mic-low conductors to enable the communications microphone 135 to be used with the wireless transceiver 530. Starting at the time the wireless transceiver 530 transitions into being in use and while it remains in use, if the bias voltage detector 590 detects a bias voltage, it's presumed that the mic-low and mic-high conductors are coupled to an intercom system, and the controller 550 operates the bias voltage supply 594 to refrain from providing a bias. If results of tests to determine whether or not the audio-left, audio-right and system-gnd conductors are also coupled to the intercom system indicate that those conductors are so coupled, then the controller 550 operates the ground coupler 592 to not couple the mic-low and system-gnd conductors, and operates the local sidetone generator 520 to not provide sidetone. However, if results of tests to determine whether or not the audio-left, audio-right and system-gnd conductors are also coupled to the intercom system indicate that those conductors are not so coupled, then the controller 550 operates the ground coupler 592 to couple the mic-low and system-gnd conductors, and operates the local sidetone generator 520 to provide sidetone.

Alternatively, starting at the time the wireless transceiver 530 transitions into being in use and while it remains in use, if the bias voltage detector 590 ever detects an absence of a bias voltage, it's presumed that the mic-low and mic-high conductors either were not coupled to an intercom system at the start of the wireless transceiver 530 being in use or were subsequently uncoupled from an intercom system while the wireless transceiver 530 was in use. In response, the controller operates the ground coupler 592 to couple the mic-low and system-gnd conductors, operates the bias voltage supply 594 to provide a bias voltage, and operates the local sidetone generator 520 to provide sidetone. Further, since the provision of a bias voltage by the bias voltage supply 594 results in the bias voltage detector 590 not being able to detect if a bias voltage is subsequently again provided by an intercom system, the controller 550 simply continues to operate the ground coupler 592 to couple the mic-low and system-gnd conductors, continues to operate the bias voltage supply 594 to provide a bias voltage, and continues to operate the local sidetone generator to provide sidetone for as long as the wireless transceiver 530 continues to indicate that it is in use.

Only when the wireless transceiver 530 ceases to indicate to the controller 550 that the wireless transceiver is in use (e.g., by entering into either an inactive operating state, or a standby operating state) does the controller 550 then operate the bias voltage supply 594 to cease providing a bias voltage and operate the local sidetone generator to cease providing sidetone. The operating of the of the bias voltage supply to cease providing a bias voltage enables the bias voltage detector 590 to once again monitor the mic-low and mic-high conductors for an indication of a bias voltage being provided by an intercom system. If the wireless transceiver 530 is transitioning to an inactive operating state (such as being turned off), then the controller also operates the ground coupler 592 to cease coupling the system-gnd and mic-low conductors, and the controller 550 once again ignores any indication by the bias voltage detector 590 of whether or not an intercom system is providing a bias voltage. Alternatively, if the wireless transceiver 530 is transitioning to a standby operating state, then whether or not the ground coupler 592 is operated to cease coupling the mic-low and system-gnd conductors will once again depend on the results of tests of whether the audio-left, audio-right and system-gnd signals are coupled to an intercom and on whether the bias voltage detector 590 detects a bias voltage being supplied by an intercom system.

Since, as just explained, it is possible for the bias voltage supply 594 to continue providing a bias voltage even after the mic-low and mic-high conductors are once again coupled to an intercom system that also provides a bias voltage, the bias voltage supply 594 is structured to avoid ever damaging an intercom system by providing a bias voltage that could be higher than a bias voltage provided by any intercom system to which the headset 1000 might be coupled. Further, the bias voltage supply 594 is also structured to incorporate one or more diodes, a rectifier and/or other protective circuitry to avoid being damaged by the provision of a higher bias voltage by an intercom system at the same time that the bias voltage supply 594 is also providing a bias voltage. It is presumed that the wireless transceiver 530 will not remain in the operating state of being in use indefinitely, since it is presumed that a user of the headset 1000 will, at some point, cease engaging in two-way communications with a wireless device through the wireless transceiver 530.

These separate tests of whether the mic-low and mic-high conductors are coupled to an intercom system and of whether the audio-left, audio-right and system-gnd conductors are coupled to an intercom system are carried out to accommodate the use of the lower cable assembly 300*b* in which the provision of two of the lower couplings 390 (one for at least the mic-low and mic-high conductors, and the other for at least the audio-left, audio-right and system-gnd conductors) enable the independent coupling and uncoupling of each of these two sets of conductors. The ability to couple only the audio-left, audio-right and system-gnd conductors to an intercom system may be deemed desirable by a user who wishes to hear communications occurring through that intercom system, but does not wish others coupled to that intercom system to hear their own two-way communications involving the headset 1000 and a wireless device (such as the wireless device 800 of FIG. 1). The ability to couple only the mic-low and mic-high conductors to an intercom system may be deemed desirable by a user who wishes to be able to say something through that intercom system, but who needs to momentarily remove the distraction of hearing others through that intercom system so that they can momentarily concentrate on listening to audio provided by either a wireless device or a wired device coupled by a cable to the headset 1000 (such as the wired device 900 of FIG. 1). Thus, the employment of these separate tests to separately determine whether or not the mic-low and mic-high conductors or the audio-left, audio-right and system-gnd conductors are coupled to an intercom system to accommodate the lower cable assembly 300*b* can result in desired flexibility in the use of the headset 1000 being provided to a user.

These separate tests, their possible interactions, and the possible resulting actions that the controller 550 may take, and which have just been described at length, are summarized in the following table:

| Audio Line Connection Status | Microphone Line Connection Status | Wireless Transceiver Status | Coupling of system-gnd & mic-low | Microphone Bias | Sidetone |
|---|---|---|---|---|---|
| not connected | not connected | inactive | not coupled | none | none |
| | | standby | coupled locally | none | none |
| | | in use | coupled locally | supplied locally | supplied locally |
| | connected | inactive | not coupled | supplied by intercom | none |
| | | standby | coupled locally | | none |
| | | in use | coupled locally | | supplied locally |
| connected | not connected | inactive | not coupled | none | none |
| | | standby | coupled locally | none | none |
| | | in use | coupled locally | supplied locally | supplied locally |
| | connected | inactive<br>standby<br>in use | coupled by intercom | supplied by intercom | supplied by intercom |

However, where the lower cable assembly 300*a* is employed in place of the lower cable assembly 300*b*, the possible interactions of the results of these separate tests, and the possible resulting actions taken by the controller 550 become greatly simplified, and are summarized in the following table:

| Audio & Microphone Line Connection Status | Wireless Transceiver Status | Coupling of system-gnd & mic-low | Microphone Bias & Sidetone |
|---|---|---|---|
| not connected | inactive | not coupled | none |
| | standby | coupled locally | none |
| | in use | coupled locally | supplied locally |
| connected | inactive<br>standby<br>in use | coupled by intercom | supplied by intercom |

As can be appreciated through the comparison of the above two tables, where the lower cable assembly 300*a* is employed in place of the lower cable assembly 300*b*, it may be possible to cease performing either the tests to determine whether the audio-left, audio-right and system-gnd conductors are coupled to an intercom system or the tests to determine whether the mic-low and mic-high conductors are coupled to an intercom system. Indeed, in one possible embodiment of the headset 1000, a switch, sensor, connector contact with a pull-down or pull-up resistor, or other mechanism may be employed to provide an indication to the controller 550 of which of the lower cable assemblies 300*a* and 300*b* are being employed at any given time, and the controller 550 may use such an indication to alter the tests that are performed to determine what conductors are coupled to an intercom system and/or to alter the actions taken by the controller 550 in response to the results of one or more of those tests.

It should be noted that the above description of these tests and possible resulting actions that the controller 550 may take are partly based on the assumption that the intercom system is active such that the intercom system will provide a bias voltage when the mic-low and mic-high conductors are coupled to the intercom system, and such that the intercom system will provide sidetone when the mic-low, mic-high, audio-left, audio-right and system-gnd conductors are all coupled to the intercom system. However, there may be situations in which the intercom system of a vehicle or large piece of machinery may not be turned or may in other ways be at least partly inactive such that a bias voltage and/or sidetone are not provided.

In some embodiments, where the mic-low and mic-high conductors are coupled to an intercom system, but the intercom system fails to provide a bias voltage, the controller 550 responds in a manner substantially similar to how it has been described above as responding to the mic-low and mic-high signals not being coupled to an intercom system. In other words, the controller 550 responds to the lack of a bias voltage being provided by the intercom system at times when a user employs the communications microphone 135 in two-way communications through the wireless transceiver 530 by operating the bias voltage supply 594 to provide a bias voltage. Unfortunately, and as will be familiar to those skilled in the art, the connection of the mic-low and mic-high signals to an intercom system that does not provide a bias voltage will likely result in a greater draw of current from the bias voltage supply 594 through the intercom system. This may be significant where the local power supply 552 is of limited capacity (e.g., is a battery or similarly limited power source) such that the local power supply 552 will be drained at an increased rate.

On occasions where all of the mic-low, mic-high, audio-left, audio-right and system-gnd conductors are coupled to an intercom system that is turned off or otherwise inactive, whether the controller 550 operates the ground coupler 592 to couple the system-gnd and mic-low conductors and whether the controller 550 operates the local sidetone generator 520 to provide sidetone may depend on how the controller 550 interprets the results of the recurring test to detect the coupling of the audio-left and/or audio-right conductors to an intercom system. As previously discussed at length, the test of whether or not the audio-left and/or audio-right conductors are coupled to an intercom system entails injecting a current into one or both of the audio-left and audio-right conductors and observing the voltage that results, where a relatively high voltage indicates that there is no such coupling and a relatively low voltage indicates that there is such a coupling. As also previously discussed, the relatively high voltage results from the lack of current flowing from the audio-left and audio-right conductors to the system-gnd conductor as a result of their being no coupling of these conductors through an intercom system, while the relatively low voltage results from their being a relatively low resistance coupling between these conductors through an intercom system that allows a current flow to take place. However, as those skilled in the art will readily recognize, the resistance through the portion of an intercom system to which the audio-left, audio-right and system-gnd conductors may be coupled does change depending on whether or not that intercom system is active such that the audio-left and audio-right conductors are being driven by that intercom system. More particularly, resistance between the system-gnd conductor and each of the audio-left and audio-right conductors is higher when an intercom system is inactive such that the audio-left and audio-right conductors are not driven than when an intercom system is active such that the audio-left and audio-right conductors are driven.

Therefore, in other embodiments, during tests to determine whether the audio-left, audio-right and system-gnd conductors are coupled to an intercom, the controller 550 evaluates the voltage(s) detected by the voltage sensor 586 to determine whether the voltage(s) fall within a range of voltages indicative of these conductors being coupled to an active intercom system, being coupled to an inactive intercom system, or not being coupled to an intercom system. In response to a voltage in a range of voltages indicative of being coupled to an active intercom system or a voltage in a range of voltages indicative of not being coupled to an intercom system, the controller 550 may take action in ways consistent with what has been previously discussed at length, above. However, in response to a voltage in a range of voltages indicative of being coupled to an inactive intercom system, the controller 550 may operate the bias voltage supply 594 and the local sidetone generator 520 to provide a bias voltage and sidetone at least at times when a user employs the communications microphone 135 to engage in two-way communications through the wireless transceiver 530. Given that the bias voltage detector 590 would be incapable of distinguishing between whether the mic-low and mic-high signals are not coupled to an intercom system or are coupled to an inactive intercom system that does not provide a bias voltage, the controller may further respond to a voltage in a range of voltages indicative of the audio-left, audio-right and system-gnd signals being coupled to an inactive intercom system by also operating the bias voltage supply 594 to provide a bias voltage at least at times when a user employs the communications microphone 135 to engage in two-way communications through the wireless transceiver 530. Alternatively, in an effort to prevent the local power supply 552 being drained at an increased rate, the controller may respond to a voltage in a range indicative of the audio-left, audio-right and system-gnd signals being coupled to an inactive intercom system by either operating the local power supply 552 to turn off many of the components of the control circuit 500 such that a user cannot use the headset 1000, or enabling only the components of the control circuit 500 that are needed to enable the user to listen to audio provided through the auxiliary connector 512.

In still other embodiments, the ability to interpret the voltage(s) observed during tests to determine whether or not the audio-left, audio-right and system-gnd conductors are coupled to an active intercom system, are coupled to an inactive intercom system or are not coupled to an intercom system may be combined with an enhanced ability to determine whether or not the mic-low and mic-high conductors are coupled to an active intercom system, are coupled to an inactive intercom system or are not coupled to an intercom system. Such an enhanced ability may be provided through the addition of an ability to detect and use periods of inactivity on the mic-low and mic-high conductors to inject a current in the mic-high conductor and measure a voltage in a manner not unlike what has been described as being done with the audio-left and audio-right conductors. Further, a microphone signal interrupter (not shown) may be incorporated into the control circuit 500 to divide the mic-low and/or mic-high conductors in a manner not unlike the dividing of the audio-left and audio-right conductors by the audio signal interrupter 582. Dividing the mic-low and/or mic-high conductors may be done at least in response to determining that these conductors are coupled to an inactive intercom system in order to avoid the previously described increased drain of power from the local power supply 552.

Still further, the approach of injecting a current into the mic-high conductor may be employed to determine whether or not the mic-low and mic-high conductors are coupled to an intercom system where the communications microphone 135 is a dynamic microphone, and not an electret microphone. As those skilled in the art will readily recognize, dynamic microphones do not require the provision of a bias voltage, and therefore, the presence or absence of a bias voltage could not be relied upon to determine whether or not the mic-low and mic-high conductors are coupled to an intercom system. Further, concerns over draining the local power supply 552 through the provision of a bias voltage by the bias voltage supply 594 would be obviated since the bias voltage supply 594 would not be present in the control circuit 500. Still further, the question of whether the mic-low and mic-high conductors are coupled to an intercom system that is either active or inactive may not be of importance in the use of the communications microphone 135 by a user to engage in two-way communications through the wireless transceiver 530. As a result, determining whether or not an intercom system is active or inactive may be of significance only in whether the controller 550 operates the local sidetone generator 520 to provide sidetone, or not.

Other embodiments and implementations are within the scope of the following claims and other claims to which the applicant may be entitled.

The invention claimed is:

1. A method of detecting coupling of a headset to an intercom system, wherein the headset comprises:

an acoustic driver to acoustically output audio to an ear of a user;

a communications microphone to detect speech sounds of the user;

a wireless transceiver to wirelessly couple the headset to a wireless device;

a cable assembly to couple the headset to an intercom system, the cable assembly comprising:

an audio conductor used to convey a signal representing audio to the acoustic driver;

a ground conductor associated with the audio conductor; and a pair of microphone conductors used to convey signals representing audio detected by the communications microphone;

an excitation current injector to inject a current into the audio conductor;

a voltage sensor to monitor a voltage of the of the audio conductor relative to the ground conductor; and a controller coupled to the excitation current injector and the voltage sensor;

the method comprising:

the excitation current injector injecting a current into the audio conductor;

the voltage sensor monitoring the voltage of the audio conductor relative to the ground conductor;

the controller determining that the audio conductor is coupled to the intercom system in response to the monitored voltage being within a first range of voltages; and determining that the audio conductor is not coupled to the intercom system in response to the monitored voltage being within a second range of voltages, wherein the second range of voltages is higher than the first range of voltages.

2. A method of detecting coupling of a headset to an intercom system, the method comprising:

injecting a current into at least one audio conductor used to convey a signal representing audio to an acoustic driver of the headset;

monitoring the voltage of the at least one audio conductor relative to a ground conductor associated with the at least one audio conductor;

determining that the at least one audio conductor is coupled to the intercom system in response to the monitored voltage being within a first range of voltages;

determining that the at least one audio conductor is not coupled to the intercom system in response to the monitored voltage being within a second range of voltages, wherein the second range of voltages is higher than the first range of voltages; and determining that the at least one audio conductor is coupled to the intercom system and determining that the intercom system is inactive in response to the monitored voltage being within a third range of voltages, wherein the third range of voltages is higher than the first range of voltages and is lower than the second range of voltages.

3. The method of claim 2, further comprising disabling a microphone bias source configured to provide a voltage across a pair of microphone conductors used to convey signals representing audio detected by a communications microphone of the headset in response to determining that the at least one audio conductor is coupled to the intercom system and in response to determining that the intercom system is not driving the at least one audio conductor.

4. A method of detecting coupling of a headset to an intercom system, the method comprising:

injecting a current into at least one audio conductor used to convey a signal representing audio to an acoustic driver of the headset;

monitoring the voltage of the at least one audio conductor relative to a ground conductor associated with the at least one audio conductor;

determining that the at least one audio conductor is coupled to the intercom system in response to the monitored voltage being within a first range of voltages;

determining that the at least one audio conductor is not coupled to the intercom system in response to the monitored voltage being within a second range of voltages, wherein the second range of voltages is higher than the first range of voltages;

performing a test of at least one microphone conductor of a pair of microphone conductors used to convey signals representing audio detected by a communications microphone of the headset to determine whether the at least one microphone is coupled to the intercom system; and monitoring the operating state of a wireless transceiver of the headset to determine if the wireless transceiver is inactive, on standby in preparation to be used in two-way communications, or in use.

5. The method of claim 4, wherein performing the test of the at least one microphone conductor comprises:

monitoring the pair of microphone conductors for a bias voltage being provided across the pair of microphone conductors;

determining that the at least one microphone conductor is coupled to the intercom system in response to detecting a bias voltage across the pair of microphone conductors; and determining that the at least one microphone conductor is not coupled to the intercom system in response to not detecting a bias voltage across the pair of microphone conductors.

6. The method of claim 4, wherein performing the test of the at least one microphone conductor comprises:

injecting a current into the at least one microphone conductor;

monitoring the voltage across the pair of microphone conductors;

determining that the at least one microphone conductor is coupled to the intercom system in response to the monitored voltage being within a first range of voltages; and determining that the at least one microphone conductor is not coupled to the intercom system in response to the monitored voltage being within a second range of voltages, wherein the second range of voltages is higher than the first range of voltages.

7. The method of claim 4, further comprising coupling the ground conductor associated with the at least one audio conductor to a microphone conductor of the pair of microphone conductors, and providing a sidetone from the communications microphone to the acoustic driver in response to either of the at least one audio conductor or the at least one microphone conductor not being coupled to the intercom system, and in response to the wireless transceiver being in use.

8. The method of claim 7, further comprising coupling the ground conductor associated with the at least one audio conductor to a microphone conductor of the pair of microphone conductors in response to either of the at least one audio conductor or the at least one microphone conductor not being coupled to the intercom system, and in response to the wireless transceiver being on standby.

9. The method of claim 4, further comprising providing a microphone bias voltage across the pair of microphone conductors in response to the at least one microphone conductor not being coupled to the intercom system, and in response to the wireless transceiver being in use.

10. A headset comprising:

an acoustic driver to acoustically output audio to an ear of a user;

a communications microphone to detect speech sounds of the user;

a wireless transceiver to wirelessly couple the headset to a wireless device;

a cable assembly to couple the headset to an intercom system, the cable assembly comprising:

an audio conductor used to convey a signal representing audio to the acoustic driver;

a ground conductor associated with the audio conductor; and a pair of microphone conductors used to convey signals representing audio detected by the communications microphone;

an excitation current injector to inject a current into the audio conductor;

a voltage sensor to monitor a voltage of the of the audio conductor relative to the ground conductor; and a controller coupled to the excitation current injector and the voltage sensor to determine that the audio conductor is coupled to the intercom system in response to the voltage sensor detecting a voltage within a first range of voltages, and to determine that the audio conductor is not coupled to the intercom system in response to the voltage sensor detecting a voltage within a second range of voltages, wherein the second range of voltages is higher than the first range.

11. The headset of claim 10, further comprising:

an audio signal presence detector coupled to the controller to detect activity on the audio conductor;

an audio signal interrupter to divide the audio conductor to isolate a portion of the audio conductor into which the excitation current injector injects a current from another portion of the audio conductor; and wherein the controller awaits an indication from the audio signal presence detector of there being no activity on the audio conductor prior to:

operating the audio signal interrupter to divide the audio conductor;

operating the excitation current injector to inject a current into the audio conductor; and awaiting an indication from the voltage sensor of the voltage of the audio conductor.

12. The headset of claim 10, wherein the controller further determines that the audio conductor is coupled to the intercom system and determines that the intercom system is inactive in response to the voltage sensor detecting a voltage within a third range of voltages, wherein the third range of voltages is higher than the first range of voltages and is lower than the second range of voltages.

13. The headset of claim 12, further comprising a bias voltage supply coupled to the controller to provide a microphone bias voltage across the pair of microphone conductors, and wherein the controller refrains from operating the bias voltage supply to provide a microphone bias voltage across the pair of microphone conductors in response to determining that the at least one audio conductor is coupled to the intercom system and in response to determining that the intercom system is not driving the at least one audio conductor.

14. The headset of claim 10, further comprising a bias voltage detector coupled to the controller to monitor the pair of microphone conductors for a microphone bias voltage conductors, wherein the controller determines that at least one microphone conductor of the pair of microphone conductors is coupled to the intercom system in response to detecting a bias voltage across the pair of microphone conductors; and wherein the controller determines that the at least one microphone conductor is not coupled to the intercom system in response to not detecting a bias voltage across the pair of microphone conductors.

15. The headset of claim 10, further comprising:

a ground coupler coupled to the controller to couple the ground conductor to one of the microphone conductors of the pair of microphone conductors in response to either the audio conductor or at least one microphone conductor of the pair of microphone conductors not being coupled to the intercom system, and in response to the wireless transceiver being in use; and a local sidetone generator coupled to the controller to generate a sidetone from the communications microphone to the acoustic driver in response to either the audio conductor or the at least one microphone conductor not being coupled to the intercom system, and in response to the wireless transceiver being in use.

16. The headset of claim 15, wherein the controller operates the ground coupler to couple the ground to a microphone conductor of the pair of microphone conductors in response to either of the at least one audio conductor or the at least one microphone conductor not being coupled to the intercom system, and in response to the wireless transceiver being on standby.

* * * * *